US005860521A

United States Patent [19]

Wu

[11] Patent Number: 5,860,521

[45] Date of Patent: Jan. 19, 1999

[54] GOLF BAG FRAME

[75] Inventor: Fang-Li Wu, Tainan Hsien, Taiwan

[73] Assignee: Sports World Enterprise Co., Ltd., Tainan Hsien, Taiwan

[21] Appl. No.: 954,514

[22] Filed: Oct. 20, 1997

[51] Int. Cl.[6] ..... A63B 55/00

[52] U.S. Cl. ..... 206/315.7; 248/96

[58] Field of Search ..... 206/45.3, 315.7, 206/315.8; 248/96

[56] References Cited

U.S. PATENT DOCUMENTS 5,407,155 4/1995 Chung ..... 206/315.7 X 5,464,180 11/1995 Cheng ..... 248/96

5,597,144 1/1997 Lee ..... 248/96

5,681,016 10/1997 Wang ..... 248/96

*Primary Examiner*—Gary E. Elkins

*Assistant Examiner*—Tri M. Mai

*Attorney, Agent, or Firm*—Rosenberg, Klein & Bilker

[57] ABSTRACT

A golf bag frame includes a position frame, a connecter, two support rods, a support connect rod and an angle adjusting base. The angle adjustable base is disposed at a lower end of the support connect rod, enabling the golf bag frame to support the golf bag in one of many sloped angles on different configurations of the ground securely. Then this golf bag frame can be applied to any conventional golf bag.

3 Claims, 8 Drawing Sheets

GOLF BAG FRAME

BACKGROUND OF THE INVENTION

This invention relates to a golf bag frame, particularly to one applicable to conventional golf bags to permit them to stand with balanced and not liable to fall down.

A conventional golf bag frame 20 shown in FIGS. 7 and 8 is fixed with a golf bag 10, by means of position holes 101, 102 formed on a same side, and position bases 211, 212 of a position frame 21 fixed in the position holes 101, 102 with screws. Further, the position frame 21 has a limit base 213 fixed at a proper point of a lower portion and having a holed lateral projection 214, a connecter 22 fixed at a proper point of an upper portion. The connecter 22 has two ends respectively and pivotally connected with a sleeve 221, which has an L-shaped wing 222 at an inner side. The sleeve 221 fits with an upper end of each of two support rods 23, 23, and the wing 222 is fixed with one of two upper ends of a Y-shaped rod connected with an upper end of a support connect rod 24. The support connect rod 24 has a lower end protrudes through the holed lateral projection 214 and fits in a fix base 242, which is pivotally connected with a pivot base 252 formed at an outer end of a support base 25. The support base 25 has an inner end fixed with a bottom of the golf bag, having a sloped surface 251 to correspond to a sloped bottom surface 11 of the golf bag 10.

When the golf bag 10 fixed with the golf bag frame 20 is to stand on the ground, the golf bag 10 is to be inclined to the constant angle of the bottom sloped surface 11, and then the sloped surface 251 of the support base 25 moved to contact with the bottom sloped surface 11, pushing the Y-shaped rod 241 and the wings 222, 222 upward, which then push the sleeves 221, 221 to swing outward to let the support rods 23, 23 spread out in supporting the golf bag in that sloped position securely, as shown in FIGS. 9 and 10.

However, the conventional golf bat 10 has a sloped bottom surface 11 to suit to the sloped surface 251 of the support base 25 so as to different sloped grounds. So the conventional golf bag frame 20 cannot be applied to a golf bag with a flat bottom, only to that with a sloped bottom surface of a certain angle, resulting in waste of resource.

SUMMARY OF THE INVENTION

This invention has been devised to offer a golf bag frame applicable to any conventional golf bag by means of an angle adjusting base to support the golf bag in one of many sloped angles securely.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
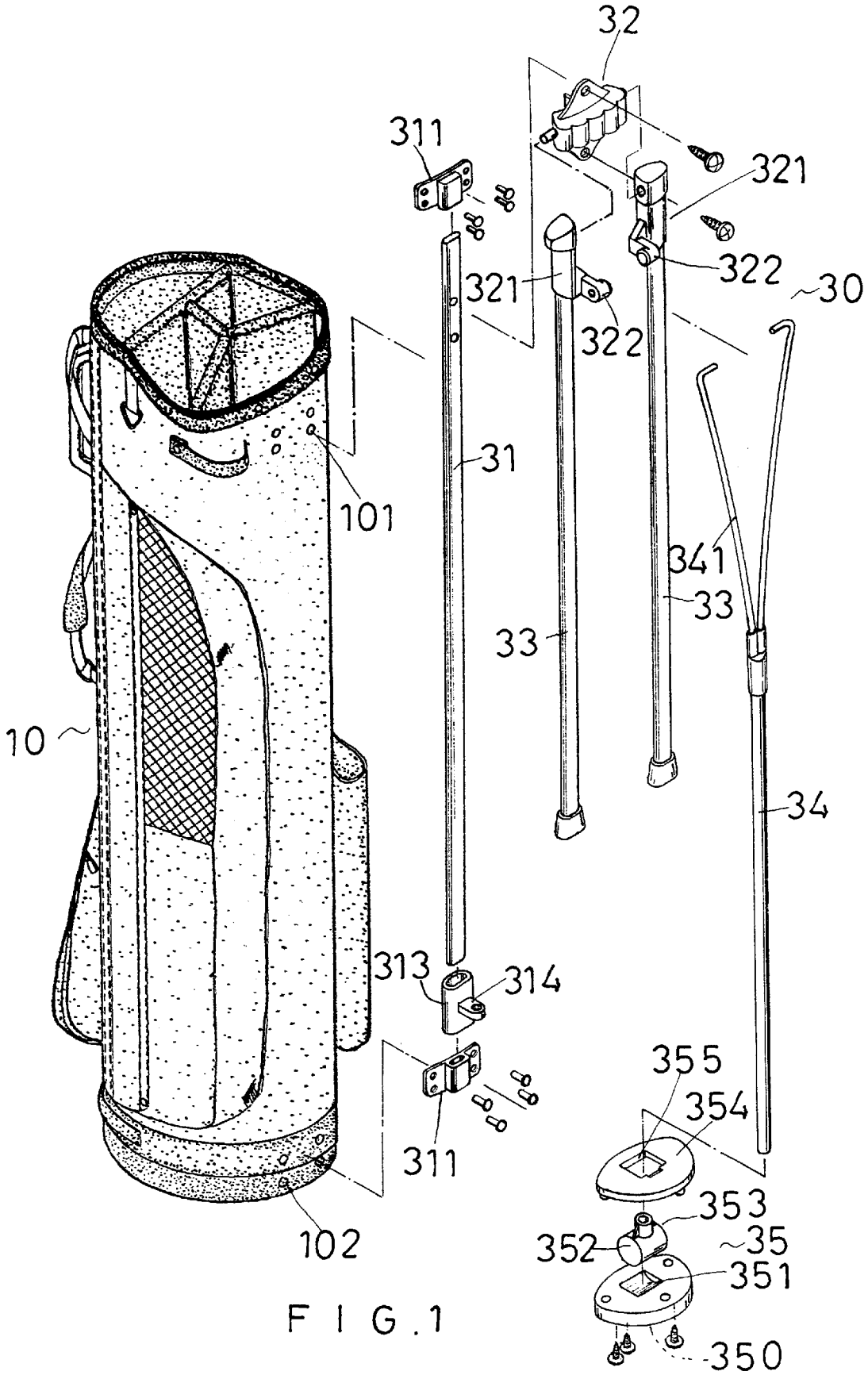
FIG. 1 is an exploded perspective view of a golf bag frame in the present invention.

A preferred embodiment of a golf bag frame in the present invention, as shown in FIG. 1, includes a position frame 31, a connecter 32, two support rods 33, 33 and a support connect rod 34 combined together for supporting a golf bag 30. And those components have the same structure as the conventional one.

Figure 2:
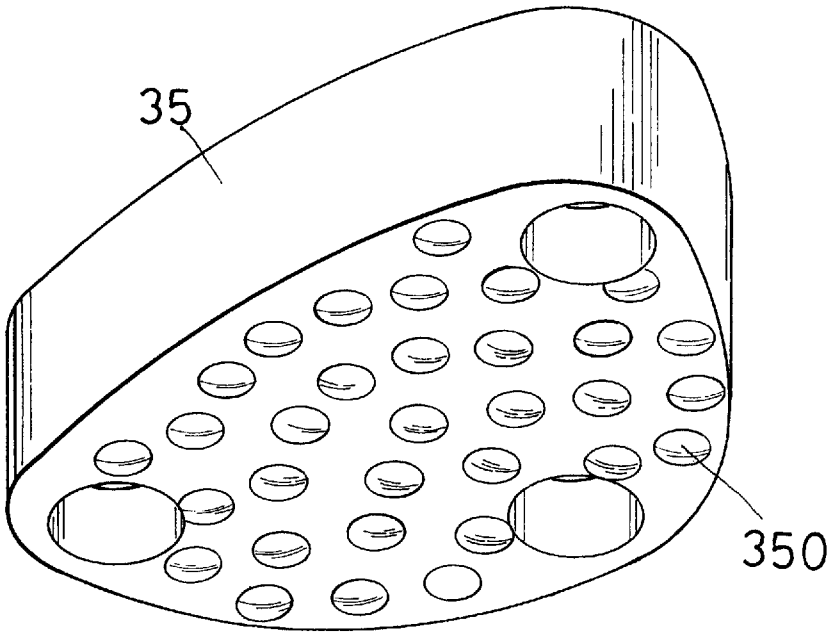
FIG. 2 is a perspective view of an angle adjusting base in the present invention.

A main feature of the invention is an angle adjustable base 35 fixed under the support connect rod 34. The angle adjustable base 35 has a plurality of anti-slide projections 350 on a bottom surface, as shown in FIG. 2, a curved-down recess 351 in an upper surface, a roll member 352 fitting in the curved-down recess 351 with an upright limit cylinder 353 formed integral on its upper side, and a cap 354 closing on the limit cylinder 352 and the angle adjustable base 35. The cap 354 has a center hole 355 for the roll member 352 and the upright limit cylinder 353 to protrude through upward.

Figure 3:
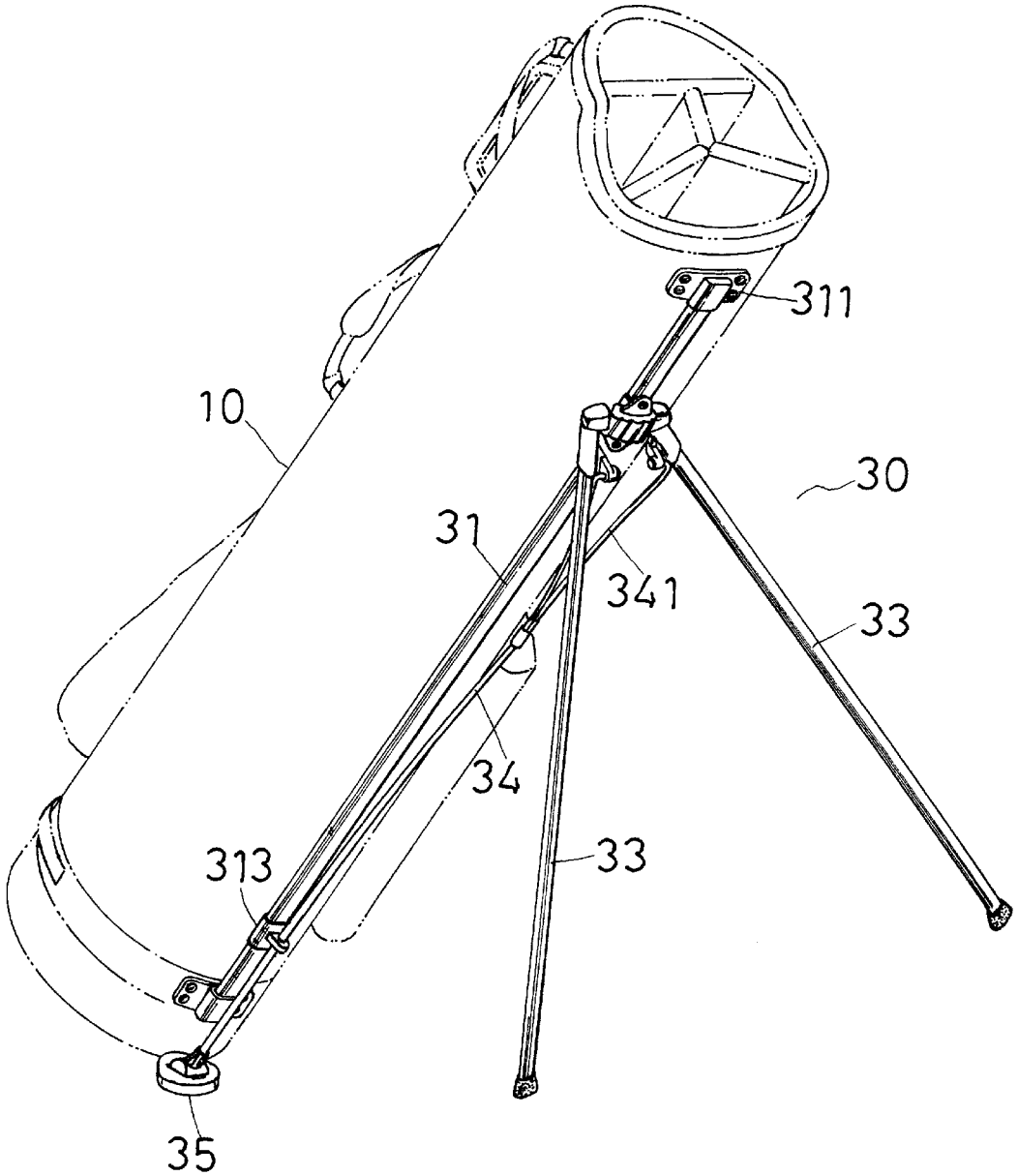
FIG. 3 is a perspective view of the golf bag frame in the present invention.
Figure 5:
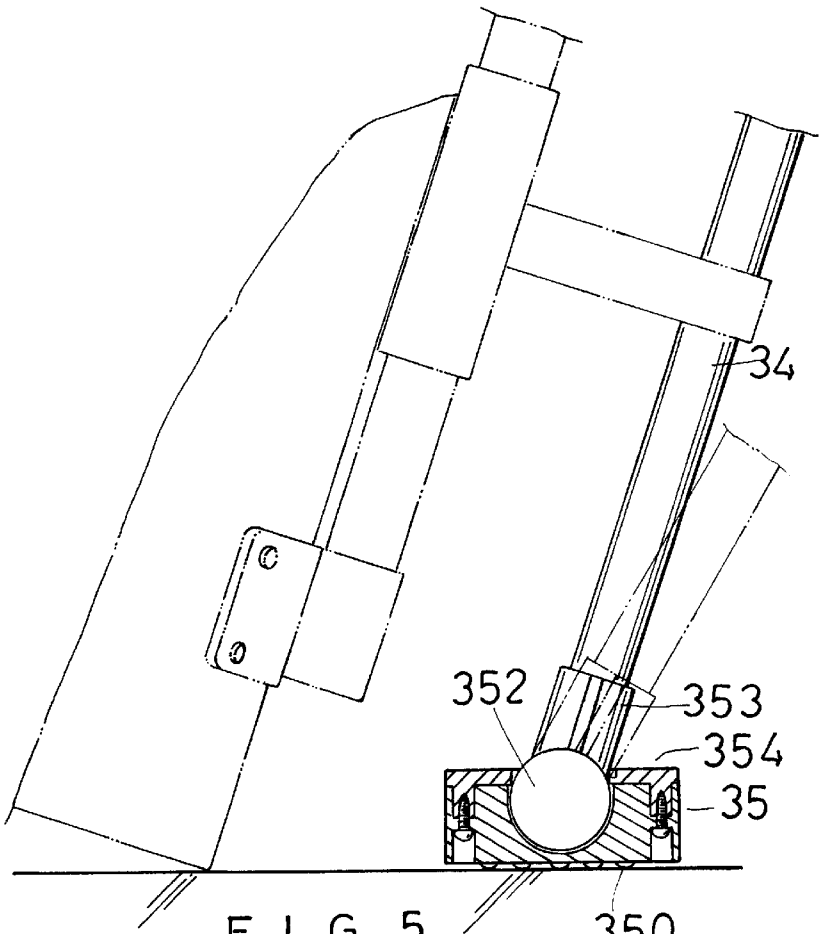
FIG. 5 is a side view of the golf bag frame used in another way in the present invention.
Figure 4:
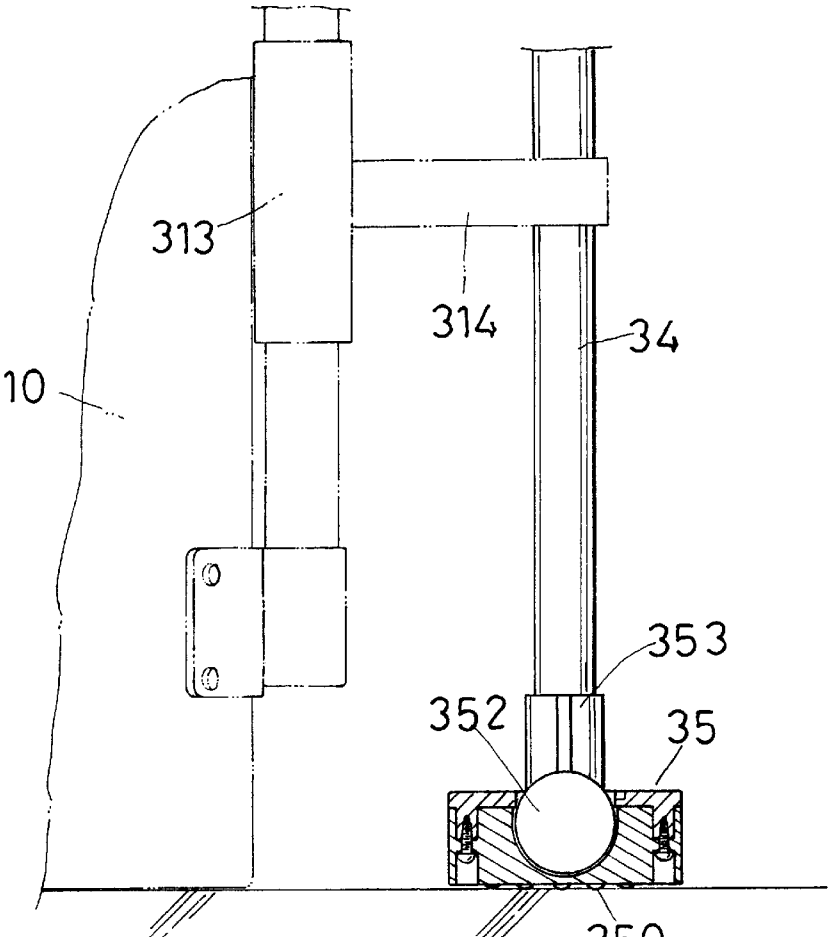
FIG. 4 is a side view of the golf bag frame used in one way in the present invention.
Figure 6:
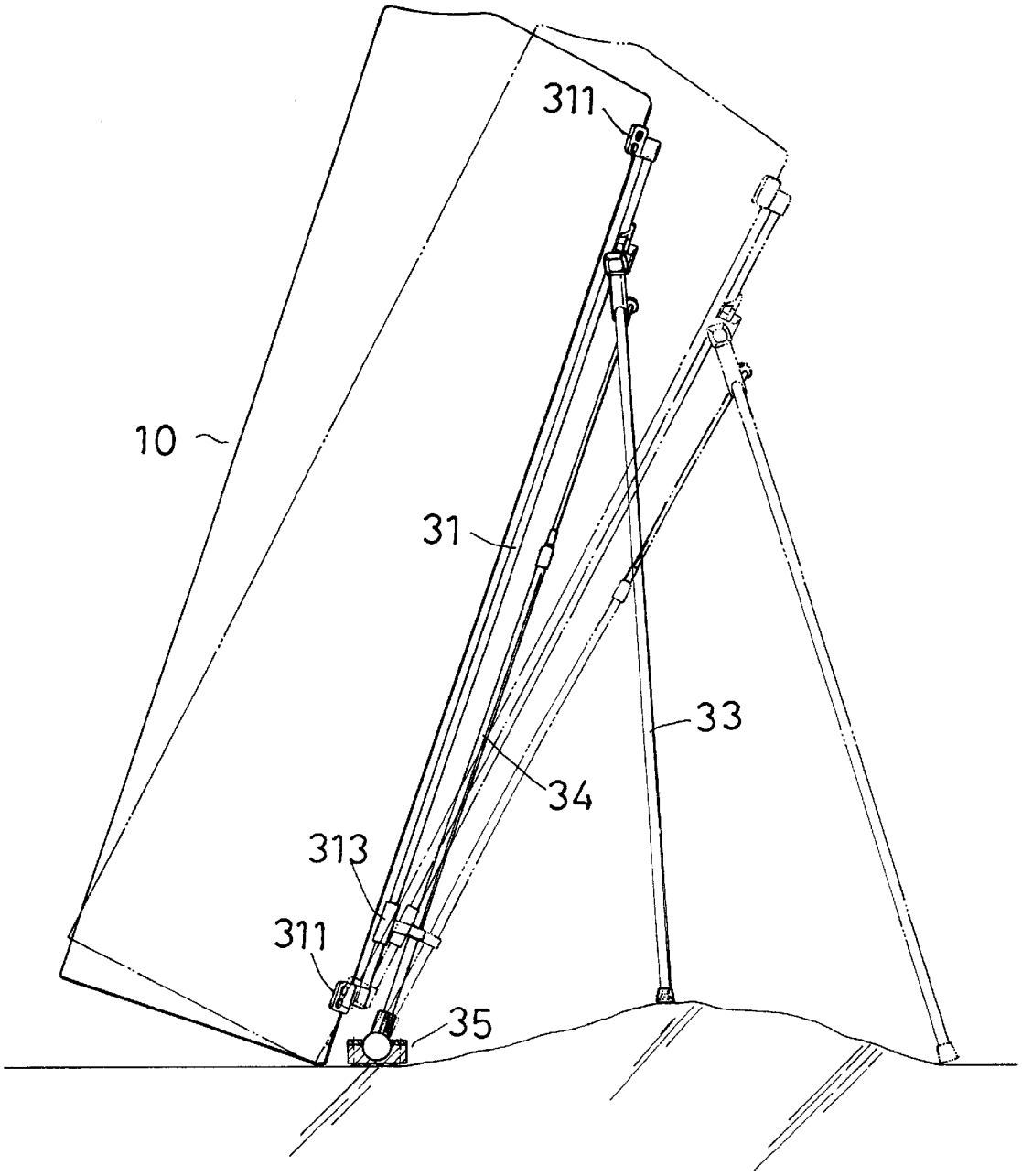
FIG. 6 is a side view of the golf bag frame used in another way in the present invention.
Figure 7:
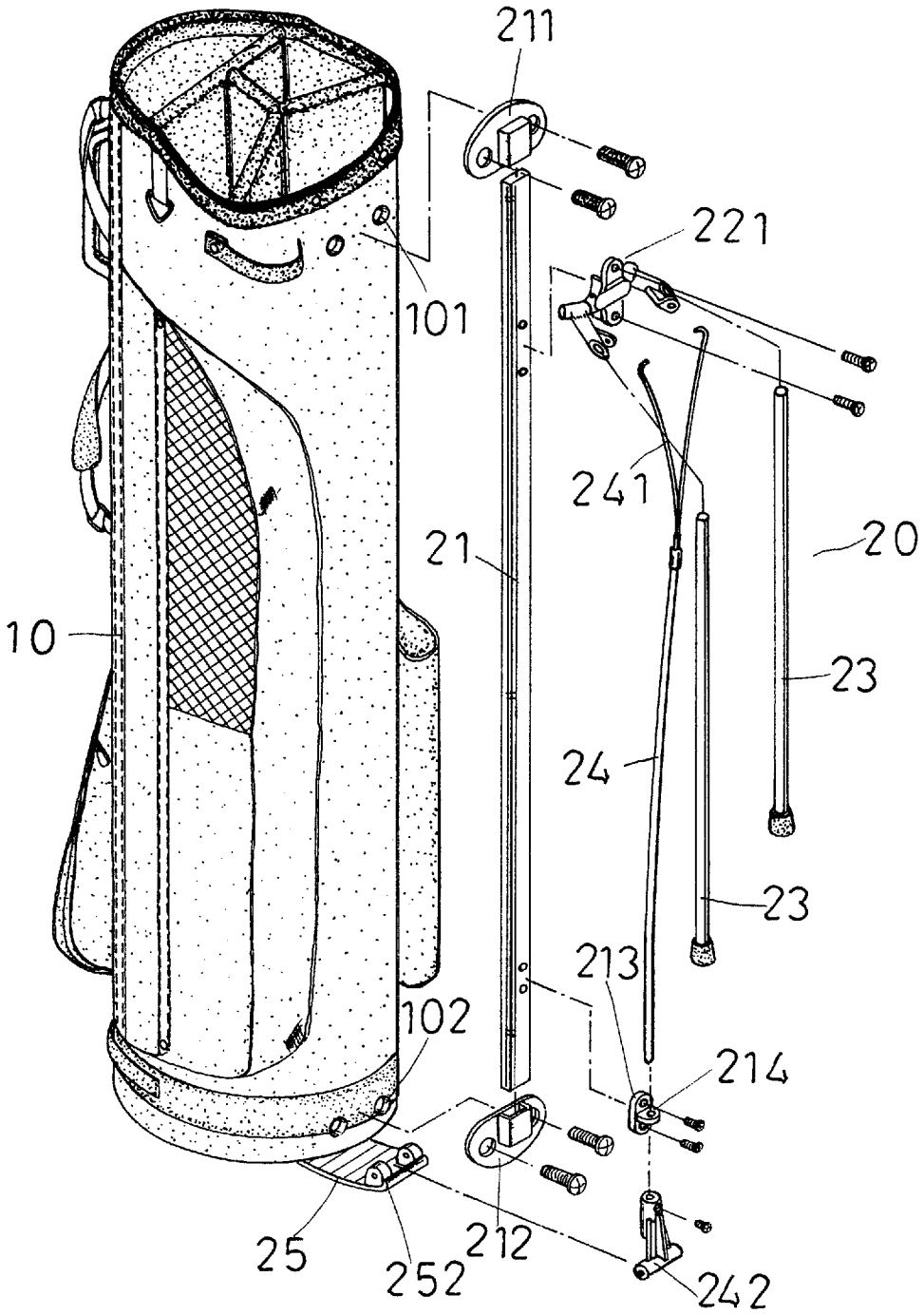
FIG. 7 (PRIOR ART)
FIG. 7 is an exploded perspective view of a conventional golf bag frame.
Figure 8:
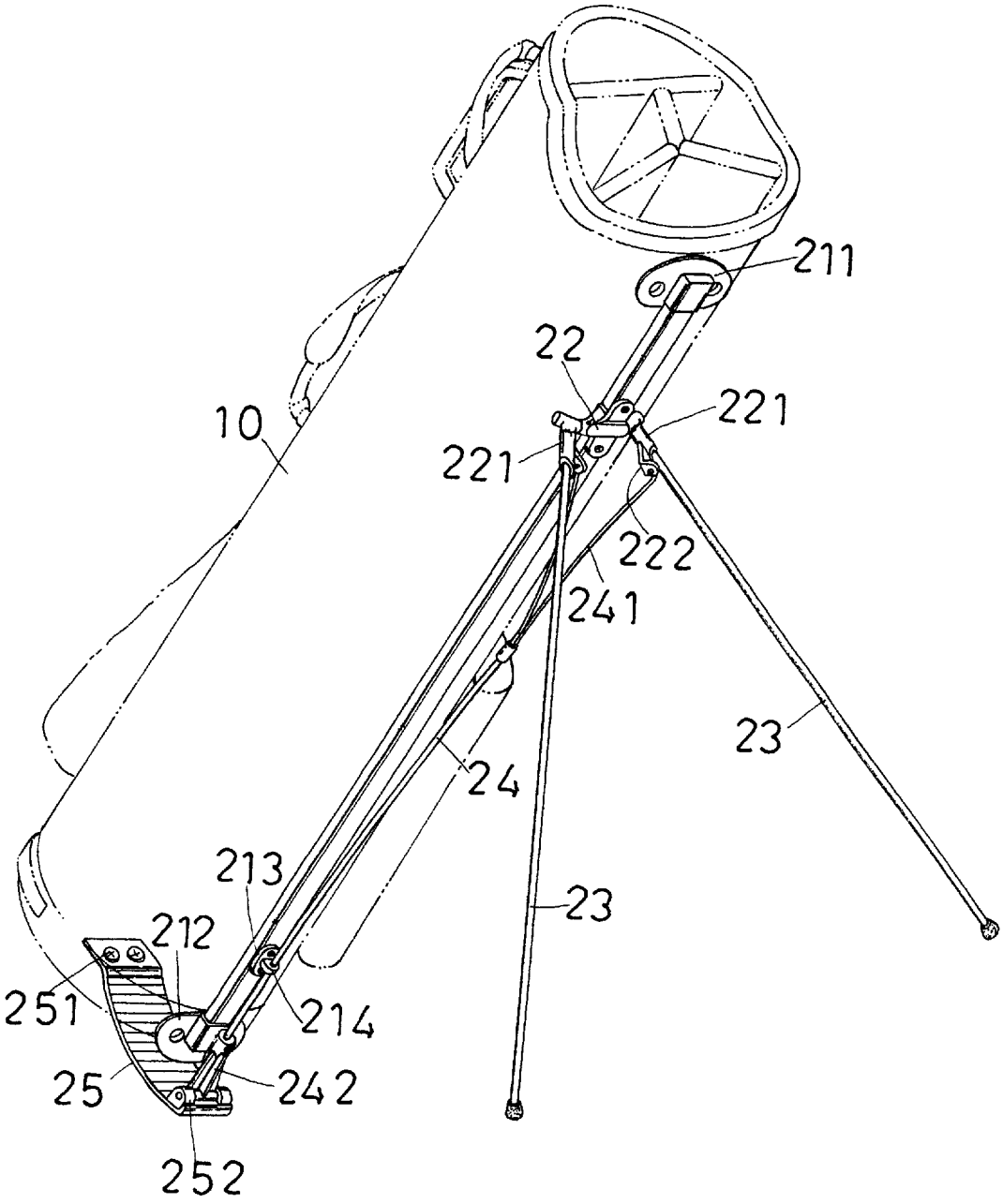
F I G. 8 (PRIOR ART)
FIG. 8 is a perspective view of the conventional golf bag frame.
Figure 10:
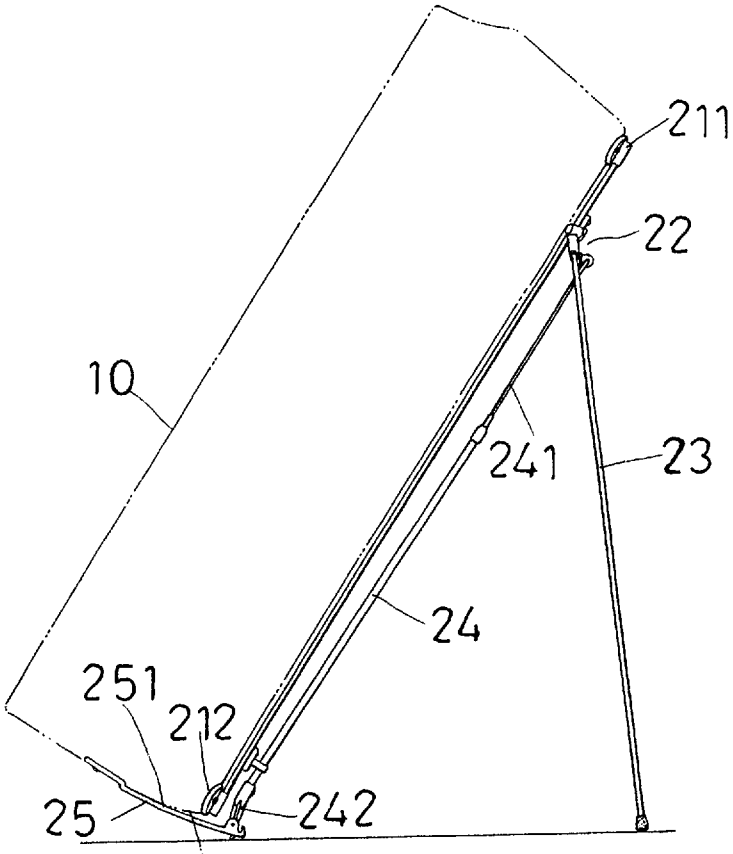
FIG. 10 (PRIOR ART)
Figure 9:
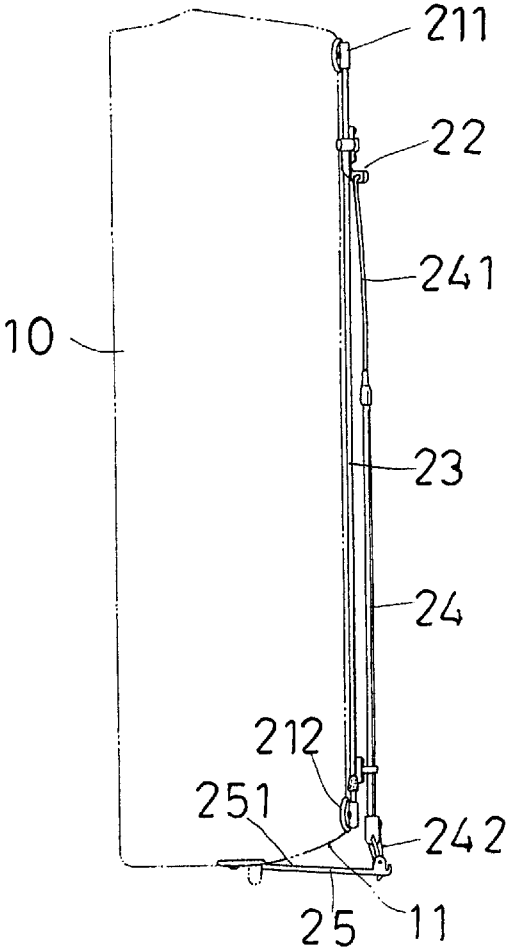
FIG. 9 (PRIOR ART)
FIG. 9 is a side view of the conventional golf bag frame used in one way; and, FIG. 10 is a side view of the conventional golf bag frame used in another way.

In assembling, referring to FIG. 3, a lower end of the support connect rod 34 is made to fit in the limit cylinder 353 of the angle adjustable base 35. In using, referring to FIGS. 4, 5 and 6, a user tilts the golf bag 10 to a certain angle needed, then the angle adjustable base 35 may be sloped accordingly to the inclination of the golf bag 10 and different configuration of the ground, and the roll member 352 also tilts to the necessary angle so that the support connect rod 34 and the Y-shaped connect rod 341 may activate the support rods 33, 33 to spread to a different angle for supporting the golf bag 10 in that angle. In addition, the anti-slide projections 350 of the angle adjustable base 35 function to stop immovable the base 35 to securely keep the golf bag 10 in that position. Conventional golf bags 10 can use the golf bag frame of the invention instead of a conventional golf bag frame, overcoming its drawback.

In collapsing the golf bag frame, the golf bag 10 is pulled upright, freeing the angle adjustable base 35 to recover an unloaded condition, with the support connect rod 34 and the Y-shaped connect rod 341 together receiving no pushing force so that wings 322, 322 of the connecter 32 may return to original positions, and so do the the sleeves 321, 321 and the support rods 33, 33 return to original positions, too.

The golf bag frame according to the invention has advantages the conventional one does not have as follows.

1. It can be applied to any conventional golf bag by means of the angle adjustable base, reducing resource waste effectively.

2. It can be securely placed on different rough surfaces of the ground, permitting the golf bag stand stabilized owing to the angle adjustable base.

3. The projections on the bottom surface of the angle adjustable base increase friction of the angle adjustable base against the ground surface when it stands thereon, reinforcing stabilization of its position and effectively preventing the golf bag from sliding or falling as well.

While the preferred embodiment of the invention has been described above, it will be recognized and understood that various modifications may be made therein and the appended claims are intended to cover all such modifications which may fall within the spirit and scope of the invention.

What is claimed is:

1. A golf bag frame, to be fixed at one side of a golf bag for supporting said golf bag stand on a ground surface, comprising a pair of support rods each having a sleeve coupled to one end thereof, a support connect rod having a Y-shaped rod end pivotally coupled to said pair of support rods, and a position frame having an upper portion and a lower portion, said upper and lower portions being respectively fixed to the golf bag, said position frame having a hole base fitting around said lower portion thereof and a connecter coupled to said upper portion of said position frame, said connecter having two sides respectively and pivotally connected to said sleeves, each said sleeve having a wing formed at an inner side thereof, said wing being pivotally coupled to said Y-shaped rod end of said support connect rod, said support connect rod having its lower end coupled to an angle adjustable base, said angle adjustable base having an arcuate recess formed in an upper surface thereof for a roll member to be displaceably disposed therein, said roll member having an upright cylinder on an upper surface thereof for coupling a lower end of said support connect rod thereto, and a cap having a center hole formed therethrough for said upright cylinder to protrude upwardly therethrough, said cap forming a closure for said angle adjustable base to position said roll member in said arcuate recess of said angle adjustable base.

2. The golf bag frame as claimed in claim 1, wherein said angle adjustable base has a plurality of projections formed on a bottom surface thereof.

3. The golf bag frame as claimed in claim 1, wherein said cap is affixed to said angle adjustable base by threaded fasteners.

* * * * *